US006535120B1

(12) United States Patent
Sebanc et al.

(10) Patent No.: US 6,535,120 B1
(45) Date of Patent: Mar. 18, 2003

(54) PROGRAMMABLE UNIVERSAL LOCATING SYSTEM

(75) Inventors: John Sebanc, Incline Village, NV (US); Robert John Chamberlin, Jamesville, NY (US)

(73) Assignee: John Sebanc, DDS, Incline Village, NV (US)

( * ) Notice: Subject to any disclaimer, the term of this patent is extended or adjusted under 35 U.S.C. 154(b) by 0 days.

(21) Appl. No.: 09/963,843

(22) Filed: Sep. 25, 2001

(51) Int. Cl.[7] ..... G08B 26/00

(52) U.S. Cl. ..... 340/505; 340/506; 340/573.1; 340/825.36; 340/825.49

(58) Field of Search ..... 340/505, 506, 340/573.1, 573.4, 572.8, 3.1, 825.36, 825.49, 5.8, 5.81

(56) References Cited

U.S. PATENT DOCUMENTS

| | | | | |
|---|---|---|---|---|
| 4,476,469 | A | 10/1984 | Lander | 340/825.49 |
| 5,598,143 | A | 1/1997 | Wentz | 340/539 |
| 5,638,050 | A | 6/1997 | Sacca et al. | 340/571 |
| 5,939,981 | A | 8/1999 | Renney | 340/539 |
| 6,346,886 | B1 * | 2/2002 | De La Huerga | 340/573.1 |

* cited by examiner

*Primary Examiner*—Daryl Pope
(74) *Attorney, Agent, or Firm*—Sierra Patent Group, Ltd.

(57) ABSTRACT

A system and methodology for a programmable and reprogrammable locating system comprising of at least one central control unit and at least one response unit. The central control unit, for activating the response unit and for programming/reprogramming the response unit, utilizes a serial bits stream signal to communicate the programming data and activation data to the response unit. Both the central control unit and the response unit utilize the generation of a square wave for discriminating between a signal as coming from a central control unit from those signals emanating from non-central control unit sources. This signal discrimination capability and signal data carrying capability allow multiple response units to be programmed/reprogrammed to one or more central control units. This programmable/reprogrammable capability gives universal adaptability in that the response unit circuitry/central control circuitry can be incorporated directly into or associated with other goods that previously lacked locating abilities. The invention's ability to be incorporated into a multitude of different goods would allow the wide spread dissemination and application of locating technology.

37 Claims, 4 Drawing Sheets

PROGRAMMABLE UNIVERSAL LOCATING SYSTEM

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND

1. Field of the Invention

The present invention relates to the field of detection and location devices and methodologies employing such devices, in particular, for those systems and devices which are used to detect and locate an object or objects, particularly remotely located objects whose location is unknown and sought by the user of the invention.

2. Description of the Related Art

In today's world, with the individual's increasing accumulation of possessions, and the progress of science and commerce constantly creating new consumer goods, it is increasingly difficult for the individual to keep track of or manage his or her possessions. The continued reduction in size of many of consumer goods containing electrical circuitry makes it easier for the individual to misplace these possessions, with a corresponding increase in difficulty in finding said misplaced possessions. Once, the haven of the lost only belonged to misplaced or mislaid glasses, keys, wallets, gloves, or other small personal items, but now the gates have opened to encompass a multitude of sophisticated electronic devices of reduced size such as portable phones, cellular phones, hand-held computers, personal calendar/diaries, remote controls for automobiles, entertainment devices and their associated remote controls, and the like. Today's individual places great reliance on his or her electronic goods, and a temporary or permanent loss of these goods can cause great impairment to that individual and his or her ability to effectively function in today's society.

There is a need for a means by which an individual can find such misplaced or waylaid items quickly and efficiently. Much of the prior art has focused on transponder/receiver technology in which a hand-held device, large enough so that it cannot be easily lost in the first place, is activated by the individual looking for the undetectable item. Upon activation, the hand-held device would emit a signal that would be detected by a receiver attached to or incorporated into the said misplaced item prior to becoming misplaced. Upon receipt of said signal, the receiver would activate its own signal generator, such as a light or sound emitter, to alert and guide the operator to the lost device's location.

The prior art location apparatus would use ultrasound, infrared, radio frequency and the like for transmission/reception as a means to provide communication between transmitter and the receiver. The various types of circuitry employed therein are well known to those versed in the art.

The U.S. Pat. No. 5,939,981 issued to Renny, U.S. Pat. No. 4,476,469 issued to Lander and U.S. Pat. No. 5,638,050 issued to Sacaa address the use of a wireless communication system comprised of a sending unit and a responding unit wherein a button on the sending unit causes the transmission of a fixed code that will be responded to by a particular responding unit.

What has not been adequately addressed by the prior art are those systems, means and apparati which would enhance the commercial viability of the location art. The issue that needs to be addressed is the allowance for the full realization of the commercial potential of the genre of the location art as a whole, not the specific means or methodology for location. What is needed is the universal capability of allowing a locating system to have a programmable/reprogrammable ability to reset a communication link between a control unit and a response unit that is connected to or made a part of the item sought to be located. This ability to program/reprogram would allow an item with a response unit to be easily integrated with one or more control units. This universal programmable/reprogrammable aspect of such location systems and methods would greatly enhance the probability that manufacturers of consumer devices would utilize the invention knowing that their products would not have a single fixed response communication link, but could easily be programmed and reprogrammed indefinitely to fit that individual consumer's location protocol. Thus, the consumer could buy a multitude of the same product or a multitude of different products, without losing the ability to find any of them when they were lost.

SUMMARY OF THE INVENTION

This invention is a universally programmable/reprogrammable locating system and method, whereby the invention has a central control unit that can interact singularly or in combination with a multitude of response devices. Each response unit, either built into or otherwise associated with a searchable item, has the capability of having its communications linked to a central control unit that is easily programmed/reprogrammed. In this manner, an individual response unit can be changeably assigned to a specific actuator of a specific central control unit. This aspect also inversely allows the assignment of a response device to a specific actuator button located on a multitude of central control units.

This aspect of the invention further allows a response unit, either sold as a separate item or incorporated as part of a consumer good, to be easily assigned by the consumer to a specific setting on the individual consumer's specific central control unit which may or may not be sold in conjunction with that particular response unit or that consumer good. At the same time, a response unit could be sold with a central control unit, both of which could be coordinated with other response units and central control units obtained at different times.

It is an object of the invention to allow the user to easily program the communication relationship between the central control unit and the response unit.

It is another object of the invention to allow a response unit to be assigned to several central control units.

It is a further object of the invention to enhance the commercial viability of the location art by permitting the response units built into one particular type of commercial goods to have the ability to be programmed in several different communication relations with a single central unit, thus allowing multiple purchases by a single consumer without losing the locating ability of any one specific good.

It is yet another object of the invention to enhance value and the resale capability of a consumer good associated with a response unit because of its universal transferability.

It is yet a further object of the invention to enhance the art of location systems in standardizing the response device which is no longer fixedly set to a specific communications relationship to a central control device.

It is yet another object of the invention to allow a user of the invention to purchase a device that is a subcomponent of goods, the subcomponent containing the response unit, thus allowing the good to acquire the location/detection capability of the subcomponent.

BRIEF DESCRIPTION OF THE DRAWINGS

The novel features that are considered characteristic of the invention are set forth with particularity in the appended claims. The invention itself, however, both as to its structure and its operation, together with the additional object and advantages thereof, will best be understood from the following description of the preferred embodiment of the present invention when read in conjunction with the accompanying drawings wherein:

LISTING OF THE ELEMENTS OF THE FIGURES

Figure 1:
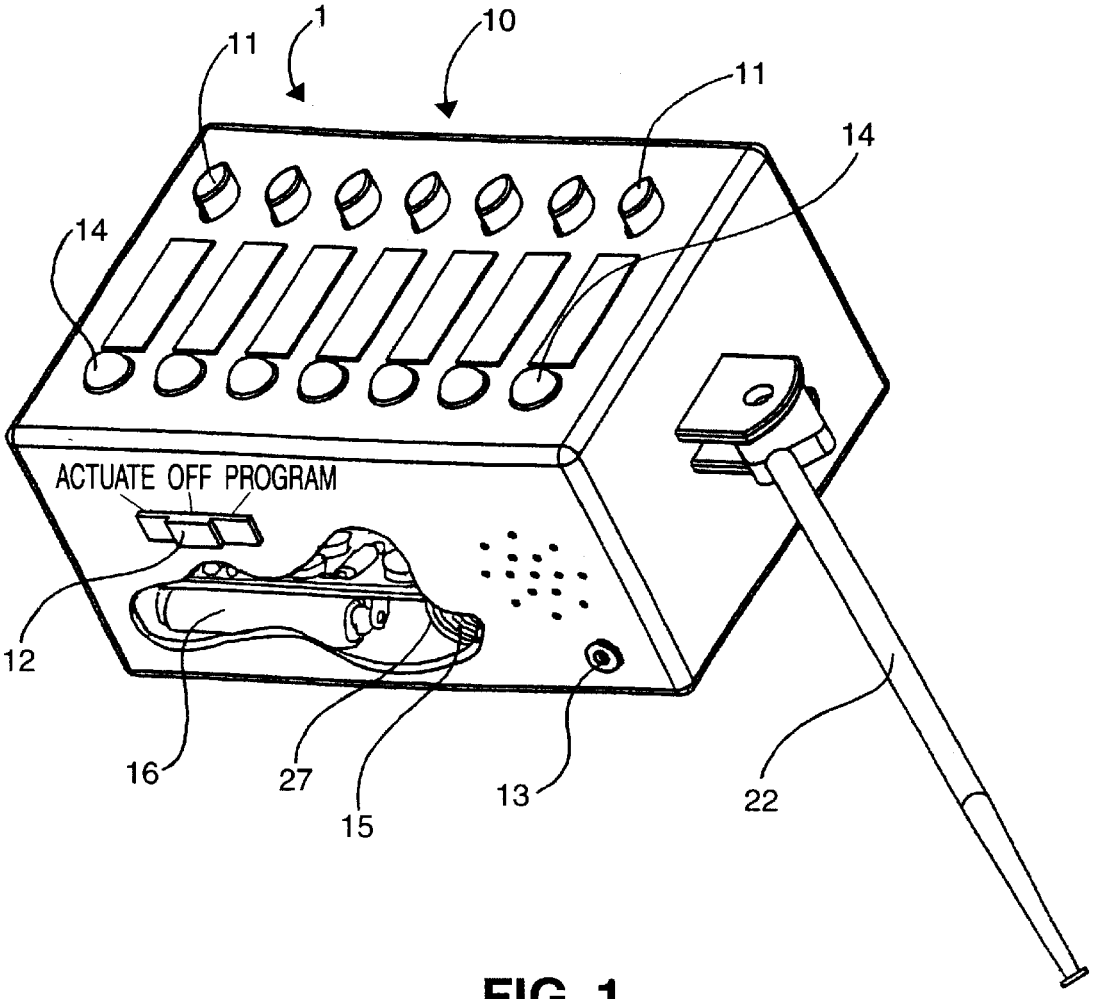
FIG. 1 depicts a partial cut-away perspective view of the central control unit.

1) the invention
10) central control unit
11) plurality of actuator switches
12) mode switch
13) electrical jack
14) light emitting source
15) sound emitting source
16) power source
20) proximity detection subsystem, generally
21) duplexer
22) antenna
23) receiver
24) signal strength indicator
25) LED drivers
26) LEDs
27) electric horn
28) tone generator
30) universal programming system
31) mode sense unit
32) output shift register
33) remote selector
34) synchronize pattern generator
35) output clock source
36) transmitter
37) remote decoder
40) response unit
41) response unit body
42) power source
43) attachment means
44) antenna
45) duplexer
46) receiver
47) transition detector
48) power control switching
49) data synchronizer and clock source
50) input shift register
51) mode detector
52) ID storage
53) ID Compare
55) transmitter
56) tone generator
57) horn

DETAILED DESCRIPTION OF THE PREFERRED EMBODIMENTS

The-present invention, programmable universal locating system and method, generally denoted by numeral 1, is comprised of two apparati, a central control unit generally denoted by numeral 10, and a response unit generally denoted by numeral 40.

As shown in FIG. 1, the preferred embodiment of the central control unit 10 would be a hand-held unit with a surface featuring a plurality of actuator switches 11. The surface would also feature a light emitting source generally referenced as numeral 14, such as LEDs (Light Emitting Diode) or the like, for indicating the relative distance between the central control unit 10 and a remotely placed response unit 40. In another embodiment of the central control unit 10, in lieu of or in addition to the light-emitting source 14, a sound-emitting source, generally referenced by numeral 15, such as a piezo horn, and its operating circuitry, could be used as well. The sound emitting device 15 could be heard by the operator through a cluster of apertures that are placed on the unit.

The surface of the unit would further support a mode selector switch 12 as well as an electrical connection jack 13 for reversibly connecting an external power supply or a external recharger to the internal power supply 16 of the central control unit 10.

The unit would encompass electronic circuitry which is connected to the power source 16, the plurality of actuator switches 11, the mode selector switch 12, the electrical connection jack 13, and the light emitting source 14 or sound emitting device 15.

In an alternative embodiment, the physically manipulated actuator switches could be replaced or supplemented with voice-activated or electronically-initiated switching circuitry.

In another embodiment of the invention 1, the central control unit 10 can also be embodied as an integral part of another good. For example, the circuitry of the central control unit 10 could be incorporated into circuitry of a power source charging unit that is used to charge the internal power source of other goods. The power source charging unit could have the external devices of the central control unit circuitry (e.g., the plurality of actuator switches, mode selection switch, etc). In this manner, the charging unit would have all the primary capabilities of the central control unit, while the goods, which the charging unit is used for, could have the circuitry of the response unit 40. In this other embodiment, the charging unit, such as a battery charger for cell phones, would allow the operator to locate the lost or misplaced goods, such as cell phones that are recharged by a battery charger.

The appearance and construction of the central control unit 10, either as a stand-alone device or as a feature that is incorporated in other goods, can vary widely since the ability to construct the device with a wide variety of "off-the-shelf" componentry is well known to those versed in the art.

Figure 2:
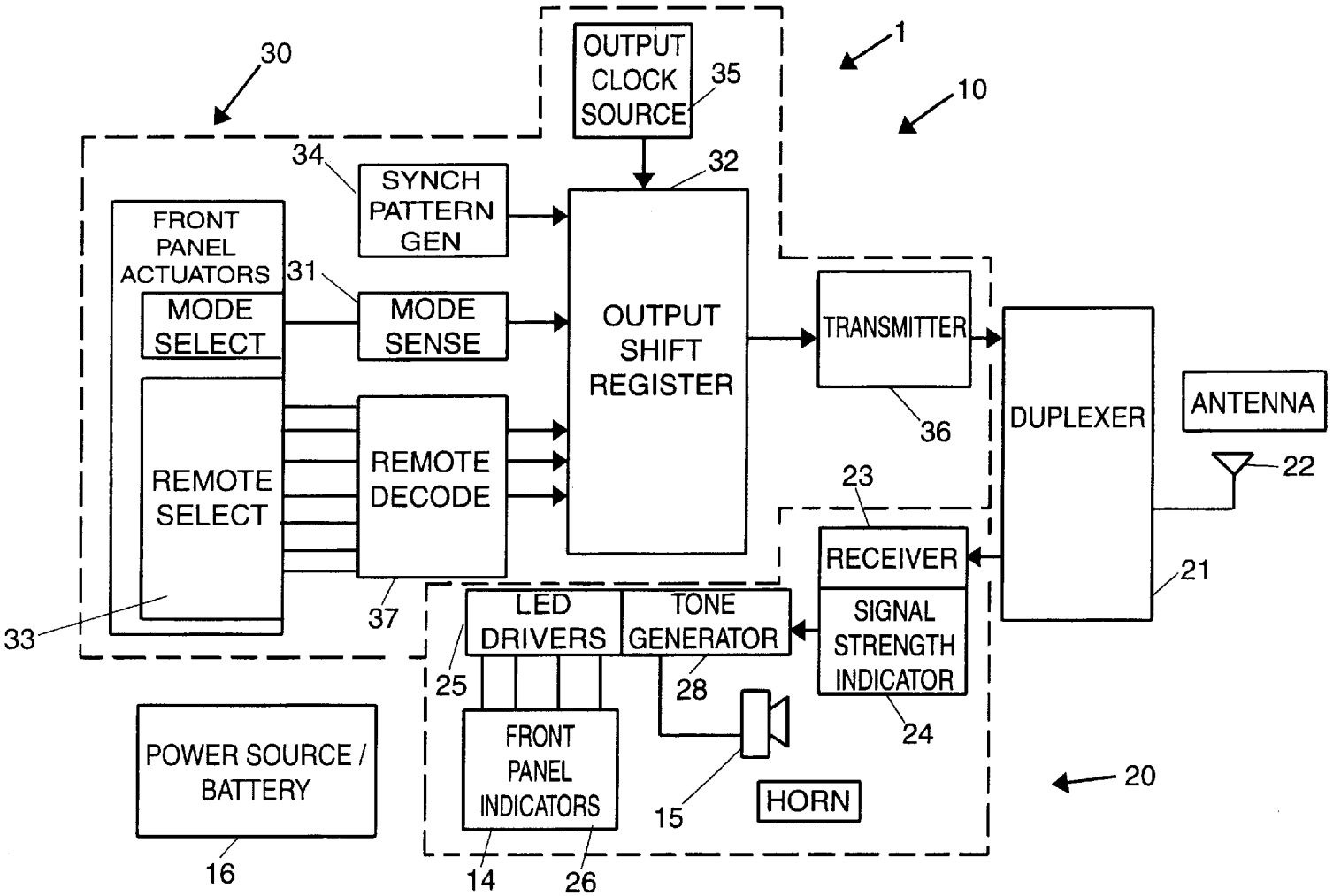
FIG. 2 depicts a block diagram of the elements of the central control unit.

As shown in FIG. 2, the block diagram of the central control unit 10, there are two basic subsystems to the central control unit 10. The first subsystem, the proximity detection unit, is generally referenced by numeral 20. The second subsystem, the universal programming system, is generally denoted by numeral 30.

The proximity detection unit 20 is comprised of a duplexer 21, a receiver 23, a signal strength indicator 24, and a light emitting 14 or sound-emitting 15 source. The duplexer 21, receives and transmits Radio Frequency ("R/F") signals ("radio waves") through its antenna 22. The duplexer 21, in filtering all the R/F signals that its antenna 22 receives, will only allow those R/F emissions which are of a certain frequency or within a certain frequency range to pass through to the receiver 23, i.e. transmissions from a remote unit 40.

Once the R/F signal is sent to the receiver 23 by the duplexer 21, the receiver 23 transforms the R/F signal into an electrical signal. This electrical signal is passed to the signal strength indicator 24, which reads strength and intensity of the electrical signal sent to it. Based on the strength of the transformed R/F signal, the signal strength indicator 24 sends an electronic signal to the LED drivers 25 whose circuitry powers up the light-emitting source 14 in the preferred embodiment (LEDs) 26. The LED drivers 25, in accordance with the intensity of the electrical signal received from the signal strength indicator 24, cause the LEDs 26 to give off a visual signal corresponding in intensity to the strength of the originally received R/F signal, either through brightness, or if the LED driver 25 incorporated a strobe circuit, through altering the frequency of flashing of the LEDs to indicate to the operator the relative proximity of the central control unit 10 to the response unit 40.

In an other embodiment, the signal strength indicator could also send an electrical signal to a tone generator 28 that would activate an electrical horn 27 or other sound emission device to give off an audible signal, that would also correspond in intensity to the strength of the received R/F signal so as to indicate to the operator the relative proximity of the central control unit 10 to the response unit 40.

The second subsystem, the universal programming system 30, which provides for activation of the programming through actuator switches 11, has a mode selector switch 12 that sets the central control unit 10 for either actuating or programming a selected response unit 40. The mode selector switch 12 is connected to a mode sense unit 31, which activates the output shift register 32 for operation into programming or activator modes. When the desired mode is set by the mode sense unit 31 for synchronizing the communication link of at least one actuator switch within the plurality of actuator switches 11, also identified as a remote select 33 of the central control unit 10, to at least one response unit 40, the mode sense unit 31 coordinates the circuitry for the output shift register 32, the synchronize pattern generator 34, the output clock source 35 and the transmitter 36, for the accomplishment of that purpose. The activation of a selected actuator sends forth an electrical signal to the remote decoder 37 which translates the signal into binary code for transmission to the output shift register 32. The output shift register 32 assembles the signals from the synch pattern generator 34, the mode sense unit 31 and the remote decoder 37 into a serial bits stream (SBS) signal.

This SBS signal has three distinct fields containing bit information: synchronize, mode and identification. The synchronized field containing data from the synchronize pattern generator 34 is used to allow the response unit 40 upon reception to align its data collection circuit with an incoming SBS R/F signal from the central control unit 10. The mode field contains data bits from the mode sense unit that establish with the response unit 40 the desired mode of operation. The identification field contains the bit pattern generated from the electrical signal from the remote decoder 37 that is specific to a particular actuator.

The output shift register 32 also uses a square wave signal made by the output clock source 35 which is used to time the transmission of the assembled signal. The square wave is what allows the coordination between the central control unit 10 and response unit 40. In this manner, R/F signal frequencies, which are limited in their ease of use and capacity, are not used to set the coordination between selected actuator switch and the chosen response units 40. Once the signal is fully assembled, the output shift register 32 sends the SBS electric signal to the transmitter 36 which transforms the SBS electrical signal into a SBS R/F signal. This SBS R/F signal is send to the duplexer 21, which blocks the SBS R/F signal from being received by the proximity detection subsystem 20 and emits the SBS R/F through the antenna 22. In the program mode, the emitted R/F SBS signal is a low level signal so as to only program/reprogram that response unit 40 which is in close proximity (e.g. adjacent to) to the operator activated central control unit 10 during the operation of the invention in the programming mode.

After at least one response unit 40 has been programmed/reprogrammed to be activated by at least one actuator switch of at least one central control unit 10, the mode selector switch 12 can then be set for actuator mode . In this mode, the mode sense unit 31 coordinates the synchronize pattern generator 34, the output clock source 35 and the output shift register 32. The activation of the selected actuator switch will cause the remote decoder 37 to emit a signal to the output shift register 32. The output shift register 32 will then assemble an SBS signal bearing bit information from the synchronize pattern generator 34, the mode sense unit 31 and the remote decoder 37. The SBS signal fields contain information similar to the programming signal, except the information in the mode field contains activation, not programming code, for the response unit 40 that was previously coordinated with the activated actuator switch.

The output shift register 32 then sends the electrical SBS signal through the transmitter 36, duplexer 21, and antenna 22 which converts the electrical signal into an R/F transmission. Once the R/F signal is picked up by the remotely located or lost coordinated response unit 40, the response unit 40 is activated to send a R/F signal back to the central control unit 10 which translates that signal based on its received strength into an audible and/or visible signal which is readily understood by the operator as being a general indication of the proximate distance between the central control unit 10 and the response unit 40.

Figure 3:
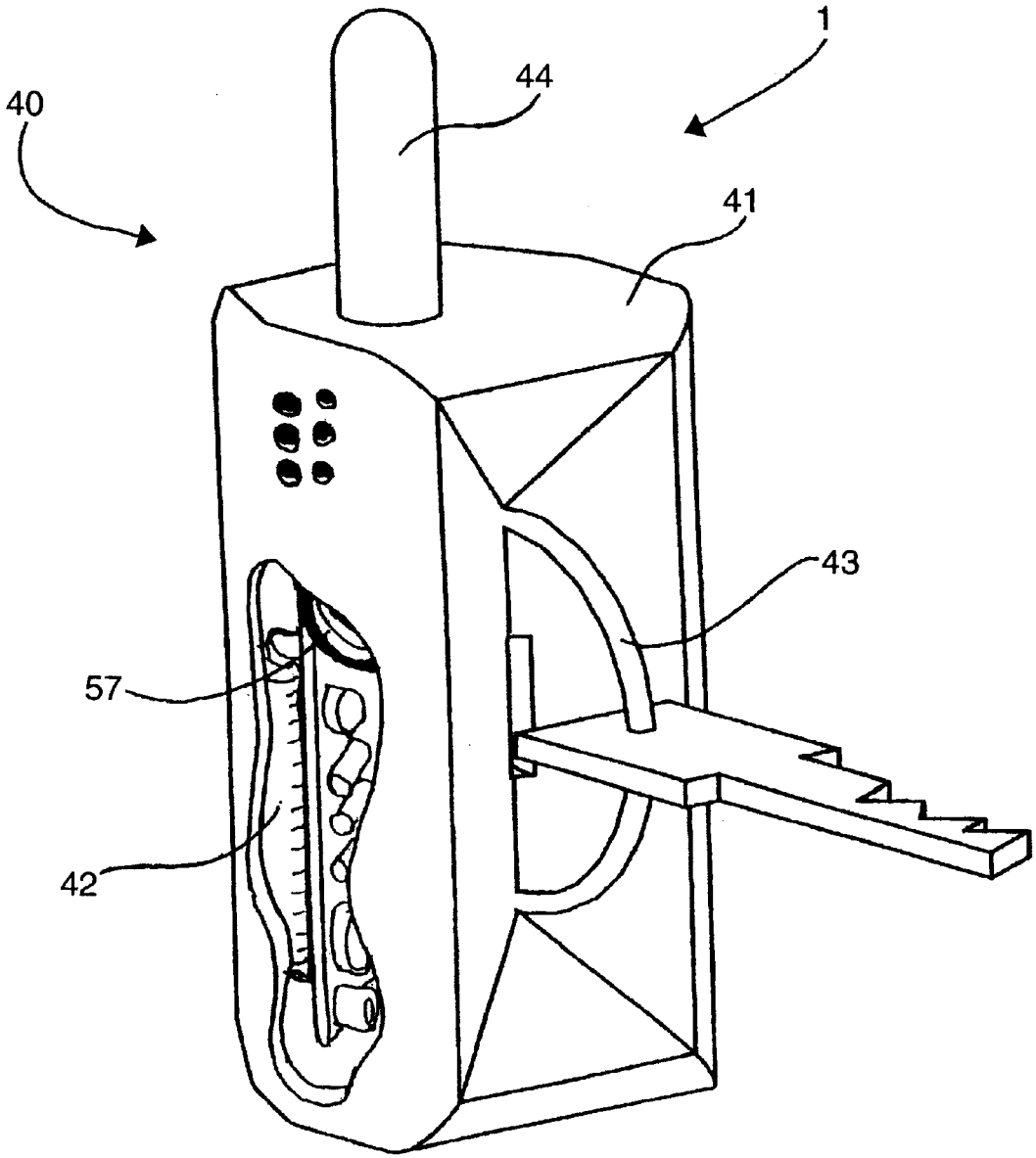
FIG. 3 depicts a partial cut-away perspective view of the response unit.

As shown in FIG. 3, the response unit 40 has a response unit body 41 that encompasses the circuitry which is connected to power source 42 also housed in the response unit body. The power source 42 can be a battery, a rechargeable battery or a direct linkup to an outside power source or to the power source of the consumer good to which the response unit 40 is attached or integrated into. For the attachment embodiment of the response unit 40, the response unit body can utilize several different attachment means 43 from hook and loop device, adhesives, clips, straps and the alike.

The response unit 40 could also be incorporated as a subcomponent of another good (cell phone) as could be the central control unit 10. In this manner, response unit 40, once integrated into the good, would afford the good all the primary location/detection aspects of the invention 1. The response unit 40 could be integrated into the goods during manufacture or during post-manufacture of the good. For example, a battery pack, removable design cover or carrying case for a cell phone could incorporate the response unit 40 to afford the location/detection benefits to a cell phone that was not originally made or designed to have such benefits. Further, the response unit could be built into a disposable power sources such as batteries or capacitors utilized by goods to confer the benefits of the invention 1 upon those goods which did not originally contain or otherwise incorporate a response unit circuitry.

Figure 4:
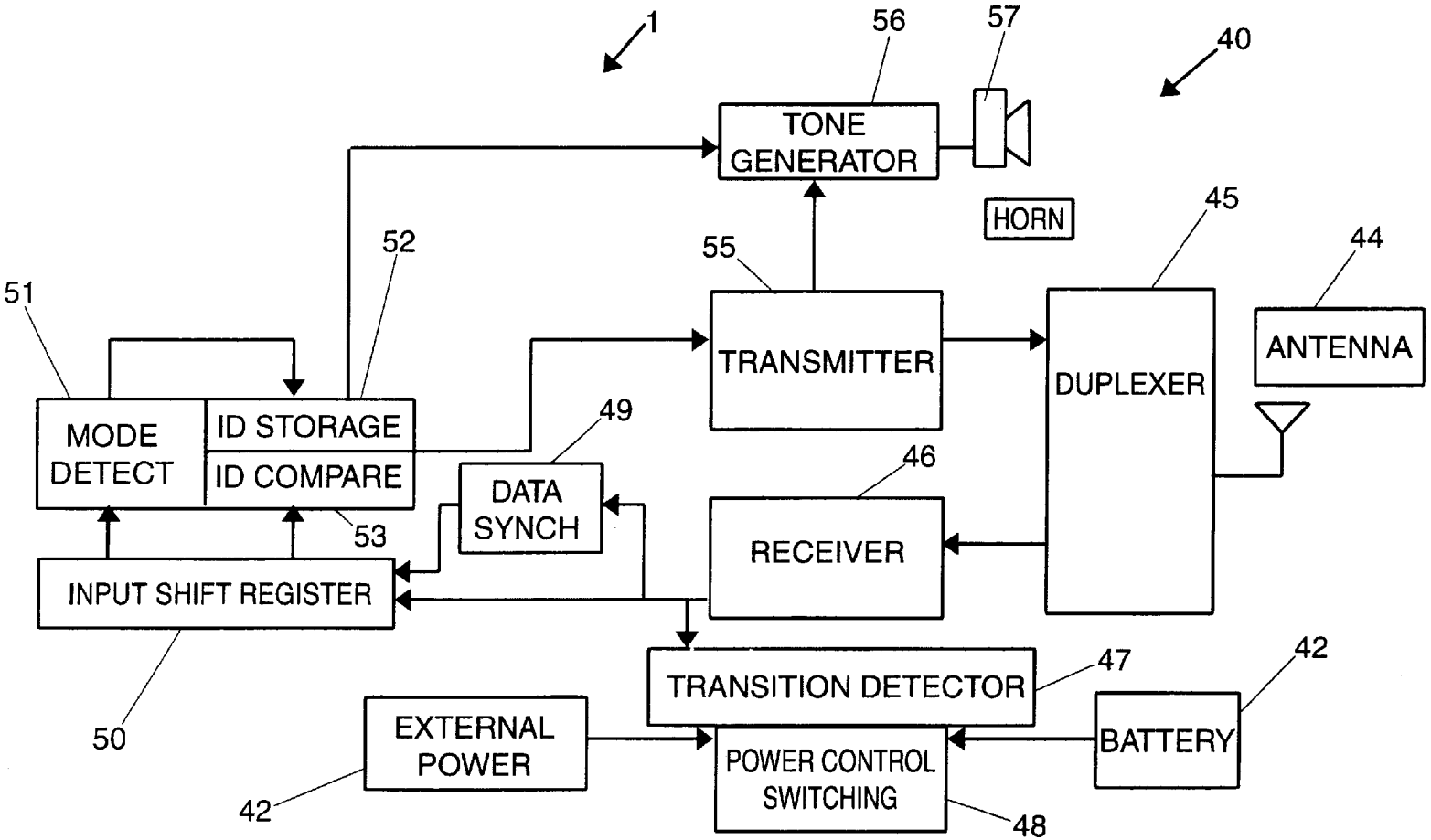
FIG. 4 depicts a block diagram of elements of the response unit.

FIG. 4 shows the block diagram of the response unit 40 which operates in two modes: program and locate. The incoming R/F SBS signal from one central control unit 10, is received by the antenna 44 of the response unit 40 and is conducted to the duplexer 45. If the received signal is within a certain preselected R/F frequency range, then the signal is passed to the receiver 46 which transforms the R/F signal into an-electronic signal. The issuance of an electronic signal is sensed by a transition detector 47. The transition detector 47 activates the power control switching 48, which is connected to an external power source, such as that of the good to which the response unit 40 is attached to or otherwise incorporated into, or a battery 42. The power control switching 48 normally has the circuitry of the response unit 40 in a low power/low drain state (i.e. only the receiver and duplexer are powered to operating states). The receipt of the proper R/F signal by the response unit 40 causes the power control switching 48 to fully power up the response unit's circuitry from a low power-energy saving state.

The energy signal also activates the data synchronizer and clock source 49 whose clock issues a square wave signal into the input shift register 50. The clock of the data synchronizer 49 and that of the central control unit's output clock source 35 are synchronized as to have a corresponding square wave signal that allows the response unit 40 to recognize the incoming signal as being from the central control unit 10. The response unit 40 is able to recognize the incoming signal as being from a central control unit 10, to which it was programed, when the incoming signal is received by the input shift register 50. At that time, the input shift register 50 receives a square wave generated by the data synchronizer and clock source 49. If this square wave matches the square wave used by the central control unit 10, then the input shift register 50 will be able to process the incoming signal. If the received signal is background noise or an other signal that was not assembled through the use of a matching square wave, then the input shift register 50 will not process that received signal.

During the input shift register 50 processing of the received signal, the bit data contained in the mode field of the incoming signal is sent to the mode detector 51 of the response unit 40. The mode detector 51 then sends a signal to the ID storage 52 and the ID compare 53 to set them for either program or actuator functions. The input shift register 50 also sends the bit data from the identification field as a signal to the ID storage 52 and the ID compare 53. If the ID storage 52 and the ID compare 53 are set for the actuator function, the ID compare 53 compares the identification field data with identification data stored in the ID storage 52. If there is a match, a signal is sent to the transmitter 55 which sends a R/F signal out through the duplexer and antenna to the remote central control unit 10 which sent the received SBS signal in the first place. The transmitter 55 also sends a signal to the tone generator 56 which activates the horn 57. The horn gives off an audible signal to guide the operator to find the response unit 40 associated with the lost object. If there is no match, no R/F signal or audible/light signal is emitted from the response unit 40 and the response unit returns to a powered down state.

The central control unit 10, upon receipt of R/F signal from the response unit 40, as described above, produces a signal which may be audible or visual or both, that is understandable and would indicate to the operator the approximate distance between the central control unit 10 and response unit 40. After a predetermined time period, the transmitter will cease transmitting and the response unit 40 will return to its low power state.

If the ID storage 52 and the ID compare 53 are set for the program function, the ID storage 52 will accept the identification bit data from the incoming SBS signal and store them either for the first time in programming of the response unit or will reprogram the response unit 40 by displacing earlier stored identification bit information with new identification bit information from the received SBS signal. The ID storage 52 unit will then send an electrical signal to the tone generator 56 which activates the horn 57. The horn 57 gives off an audible signal to inform the operator that the response unit 40 has been programmed or reprogrammed by accepting the identification code.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A method for programming communications for a locating system having at least one central control unit with transceiving capability, a mode selector, and at least one actuator, and at least one response unit with transceiving capability and memory, comprising:

a. setting at least one central control unit to a programming mode;

b. activating at least one actuator;

c. transmitting from at least one central control unit a signal containing identification data that corresponds specifically to the particular activated actuator;

d. receiving said transmitted signal by at least one response unit; and e. retaining in the storage memory of at least one response unit, said identification data contained in the signal.

2. The method of claim 1 wherein the transmitted signal has a synchronization field that contains data; said method wherein a response unit is responsive to the reception of said data, aligning its circuitry for reception of the information contained in the signal.

3. The method of claim 1 wherein the transmitted signal contains a mode field which can hold data that establishes with said response unit a mode of operation corresponding to that of said central control unit.

4. A method of programming communications for a locating system as claimed in claim 3 wherein the mode established by the response unit will match the mode of the central control unit.

5. A method of programming communications for a locating system as claimed in claim 1 wherein an additional step is generating a square wave that is used to discriminate a signal as coming from the central control unit.

6. A method of programming communications for a locating system as claimed in claim 5 wherein both the central control unit and the response unit generate a square wave.

7. The method of claim 1 wherein the retaining in the storage memory said identification data comprises:

said response unit displacing previously stored data with said identification data.

8. The method of claim 1 further comprising placing said central control unit in close proximity to said response unit.

9. A method of activating a response unit for a locating system having at least one central control unit with transceiving capability, a mode selector, and at least one actuator, and at least one response unit with transceiving capability and memory, both units are capable of operating in at least two modes, actuating and programming, comprising:

a. setting at least one central control unit to an actuator mode;

b. activating at least one actuator;

c. transmitting from at least one central control unit a signal containing identification data that corresponds specifically to the particular activated actuator;

d. receiving said transmitted signal by at least one response unit;

e. comparing by the response unit said identification data contained in said transmitted signal with data previously stored in the memory of the response unit; and f. responding to a match between said transmitted identification data and said previously stored data by providing at least one signal that is used to locate the response unit.

10. The method of claim 9 wherein said step of providing a signal comprises:

said central control unit responding to the reception of a signal from said response unit by producing a signal that indicates the approximate distance between said central control unit and said response unit, based on the strength of said received signal.

11. The method of claim 10 where the signal produced by said central control unit is chosen from the group comprising:

a visual signal; and an audible signal.

12. The method of claim 9 wherein the signal used to locate the response unit is chosen from the group comprising:

a signal produced by the response unit that is used by the central control unit to indicate the approximate distance between the central control unit and the response unit; and an audible signal produced by the response unit.

13. The method of claim 9 further comprising the generation of a corresponding square wave that is used to discriminate a signal as coming from the central control unit.

14. The method of claim 13, wherein both the central control unit and the response unit generate a square wave.

15. The method of claim 14, wherein the square waves of the central control unit and the response unit match.

16. The method of claim 9, wherein the transmitted signal has a synchronization field that contains data; said method, wherein a response unit is responsive to the reception of the data, aligning its circuitry for reception of information contained in an incoming signal from the central control unit.

17. The method of claim 9, wherein the transmitted signal contains a mode field which can hold data that establishes with the response unit a mode of operation corresponding to that of the central control unit.

18. The method of claim 17, wherein the mode established by the response unit matches the mode of the central control unit.

19. A locating system having at least one central control unit with transceiving capability, a mode selector, and at least one actuator, and at least one response unit with transceiving capability and memory, both units are capable of operating in at least two modes, actuating and programming, comprising:

means in the central control unit for setting to a programming mode;

means in the central control unit for setting to an actuator mode;

means in the central control unit for activating at least one actuator;

means in the central control unit for transmitting a signal containing identification data that corresponds specifically to the particular activated actuator;

means in the response unit for receiving said transmitted signal;

means in the response unit for retaining in the storage memory said identification data contained in the signal;

means in the response unit for comparing said identification data contained in said transmitted signal with data previously stored in the memory of the response unit; and means for responding to a match between said transmitted identification data and said previously stored data by providing at least one signal that is used to locate the response unit.

20. The system of claim 19, wherein said means for responding by providing a signal comprises:

means in the central control unit for responding to the reception of a signal from the response unit by producing a signal that indicates the approximate distance between the central control unit and the response unit, based on the strength of the received signal.

21. The system of claim 20, wherein the signal is produced by one of the means of the group comprising:

a visual signal means; and an audible signal means.

22. The system of claim 19, wherein the signal used to locate the response unit is produced by one of the means of the group comprising:

means in the response unit for producing a signal that is used by the central control unit to indicate the approximate distance between the central control unit and the response unit; and an audible signal means in the response unit.

23. The locating system of claim 19, further comprising:

means for generating a corresponding square wave that is used to discriminate a signal as coming from the central control unit.

24. The locating system of claim 19, further comprising:

means for the transmitted signal having a synchronization field that contains data; and means for a response unit to be responsive to the reception of the data, aligning its circuitry for reception of information contained in an incoming signal from the central control unit.

25. The locating system of claim 19, further comprising:

means for the transmitted signal containing a mode field which can hold data that establishes with the response unit a mode of operation corresponding to that of the central control unit.

26. A central control unit, having transceiving capability, a mode selector, and at least one actuator, comprising:

means for being set to a programming mode;

means for being set to an actuator mode;

means for said actuator being activated;

means for transmitting a signal containing identification data that corresponds specifically to the particular activated actuator; and means for responding to a match between said transmitted identification data and data previously stored in a response unit by providing at least one signal that is used to locate another device.

27. The central control unit of claim 26, wherein said means for responding by providing a signal comprises:

means for responding to the reception of a signal from the response unit by producing a signal that indicates the approximate distance between the central control unit and the response unit, based on the strength of the received signal.

28. The central control unit of claim 27, wherein the signal is produced by one of the means of the group comprising:

a visual signal means; and an audible signal means.

29. The central control unit of claim 26, further comprising:

means for generating a corresponding square wave that is used to discriminate a signal as coming from the central control unit.

30. The central control unit of claim 26, further comprising:

means for the transmitted signal having a synchronization field that contains data; said data causing a response unit to align its circuitry for reception of information contained in an incoming signal from the central control unit.

31. The central control unit of claim 26, further comprising:

means for the transmitted signal containing a mode field which can hold data that establishes with a response unit a mode of operation corresponding to that of the central control unit.

32. A response unit, having transceiving capability and memory, comprising:

means for receiving a transmitted signal containing identification data that corresponds specifically to a particular activated actuator;

means for retaining in the storage memory said identification data contained in said signal;

means for comparing said identification data contained in said transmitted signal with data previously stored in said memory; and means for responding to a match between said transmitted identification data and said previously stored data by providing at least one signal that is used to locate said response unit.

33. The response unit of claim 32, wherein the signal that is used to locate said response unit is provided by one of the means of the group comprising:

an audible signal means; and means for producing a signal that is used by a central control unit to indicate the approximate distance between the central control unit and the response unit.

34. The response unit of claim 32, further comprising:

means for generating a corresponding square wave that is used to discriminate a signal as coming from the central control unit.

35. The response unit of claim 32, further comprising:

means for being responsive to a transmitted signal having a synchronization field that contains data, aligning circuitry for reception of information contained in an incoming signal from the central control unit.

36. The response unit of claim 32, further comprising means for using a transmitted signal containing a mode field to establish a mode of operation corresponding to that of the central control unit.

37. A method of programming communications for a locating system as claimed in claim 6 wherein the square waves of the central control unit and the response unit match.

* * * * *